United States Patent [19]

McNally

[11] 3,977,506

[45] Aug. 31, 1976

[54] COIN SLIDE ASSEMBLY

[75] Inventor: William McNally, Newton, Iowa

[73] Assignee: The Maytag Company, Newton, Iowa

[22] Filed: Nov. 19, 1975

[21] Appl. No.: 633,448

[52] U.S. Cl. ..... 194/55; 194/102

[51] Int. Cl.[2] ..... G07F 3/02

[58] Field of Search ..... 194/55, 56, 57, 58, 194/59, 60, 101, 102, 1 G

[56] References Cited

UNITED STATES PATENTS

| | | | |
|---|---|---|---|
| 2,925,163 | 2/1960 | Parre et al. | 194/55 |
| 3,602,352 | 8/1971 | Robinson | 194/92 |
| 3,712,440 | 1/1973 | Greenwald | 194/55 |
| 3,732,962 | 5/1973 | Hall | 194/92 |

*Primary Examiner*—Allen N. Knowles
*Attorney, Agent, or Firm*—Richard L. Ward

[57] ABSTRACT

A coin slide apparatus which includes a housing for mounting the apparatus to a machine, a coin slide assembly, and a guideway in the housing for the coin slide assembly to operate within. The coin slide assembly is reciprocally operable in the guideway from an extended coin receiving position through coin measuring and coin ejection positions to a position for initiating operation of the machine. The movable slide assembly comprises three main members: an upper slide plate, a center body portion, and a latch plate. The upper slide plate is formed to include the operating handle at one end and has coin receiving slots of a predetermined size. The center body portion gives the slide assembly the necessary thickness to support coins on edge, serves as a storage area for blanking members which are used to convert the apparatus from one combination of coins to another, and mounts a ratchet pawl which prevents the slide from being withdrawn without a complete reciprocation. The latch plate mates with latch arms, which are mounted on the housing, to prevent operation either without coins or with spurious coins. The coin slide apparatus also includes various devices for measuring coins and a coin ejection system for removing coins from the slide assembly and depositing them in a receptacle.

12 Claims, 15 Drawing Figures

COIN SLIDE ASSEMBLY

BACKGROUND OF INVENTION

1. Field of the Invention

This invention relates to the field of coin actuated machines and more particularly to a coin slide apparatus therefor.

2. Description of the Prior Art

Prior coin slide art shows a continuing search for coin slide apparatus operable with varying combinations of coins. U.S. Pat. No. 3,602,352, for example, discloses a system operable with a plurality of vertical coins that utilizes blanking plates to simulate genuine coins and thereby actuate the measuring device with less than the total number of coins. U.S. Pat. No. 3,712,440 is similar and discloses the use of blanking members to close the coin slots but requires adjustment of a latching dog to remove the latching dog from the system. Further, in U.S. Pat. No. 3,732,962 the apparatus is operable with a plurality of coins but various caliper blocks and stop blocks must be changed to accommodate different combinations of coins. All of these systems require a relatively large degree of mechanical manipulation to accomplish the desired conversion and none of these systems include any means for storing the required conversion members within the slide itself.

SUMMARY OF THE INVENTION

It is an object of the instant invention to provide an improved movable coin slide assembly for coin slide apparatus.

It is a further object of the instant invention to provide a coin slide apparatus wherein the coin slide assembly is easily disassembled and converted from one combination of coins to another combination.

It is a further object of the instant invention to provide for ready conversion of the coin slide assembly through storage of the necessary blanking members within the slide assembly.

It is a further object of the instant invention to utilize the slide assembly as a mount for a ratchet pawl to prevent actuation of the coin slide apparatus without a complete reciprocation of the slide assembly.

It is a further object of the instant invention to provide a coin slide assembly of three piece construction having means for transmitting operational impact force from the handle to the center plate instead of to the fasteners.

It is a still further object of the instant invention to provide a method of cooperation between the slide assembly and the slide housing to prevent insertion of a flat, rigid sheet of material between the two for improper actuation of the slide apparatus.

Briefly, the instant invention achieves these objects in a coin slide apparatus that includes a housing and associated mounting means combined with a coin slide assembly and various coin measuring devices.

Operation of the apparatus and further objects and advantages thereof will become evident as the description proceeds and from an examination of the accompanying six pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
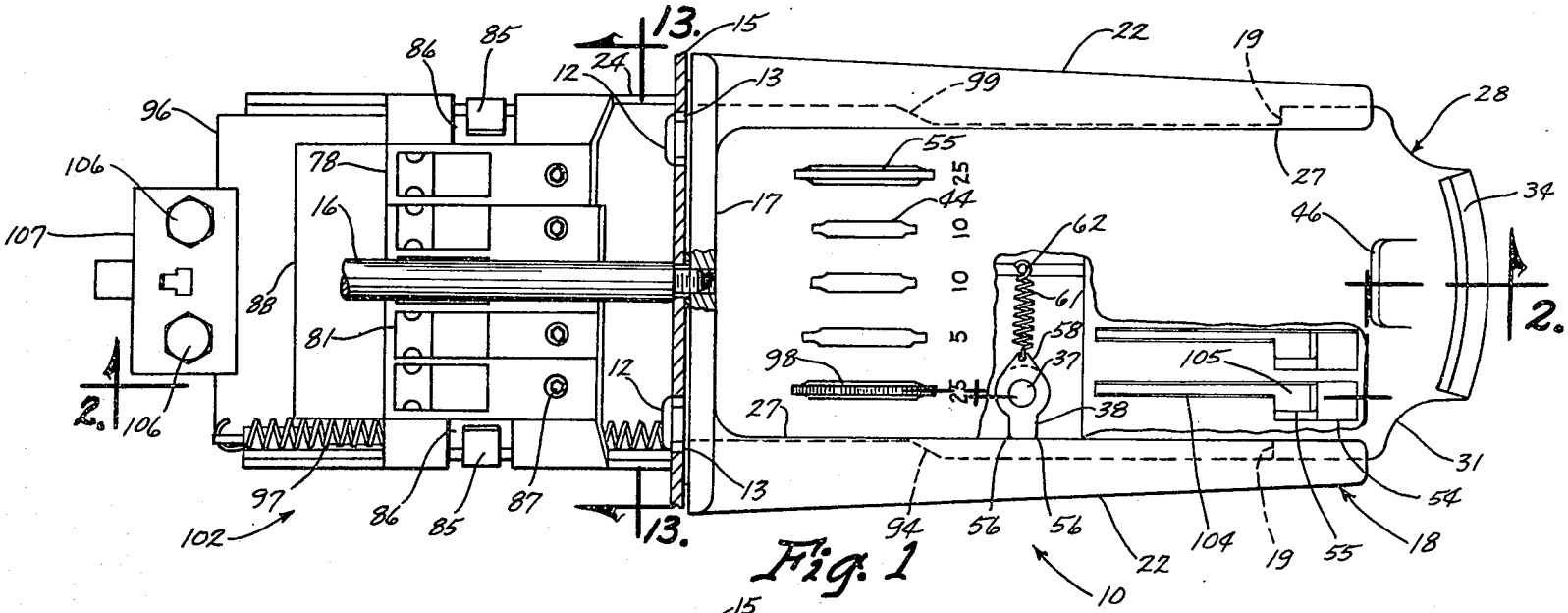
FIG. 1 is a plan view of the coin slide apparatus with a portion broken away to show the ratchet pawl and the blanking members in storage.
Figure 2:
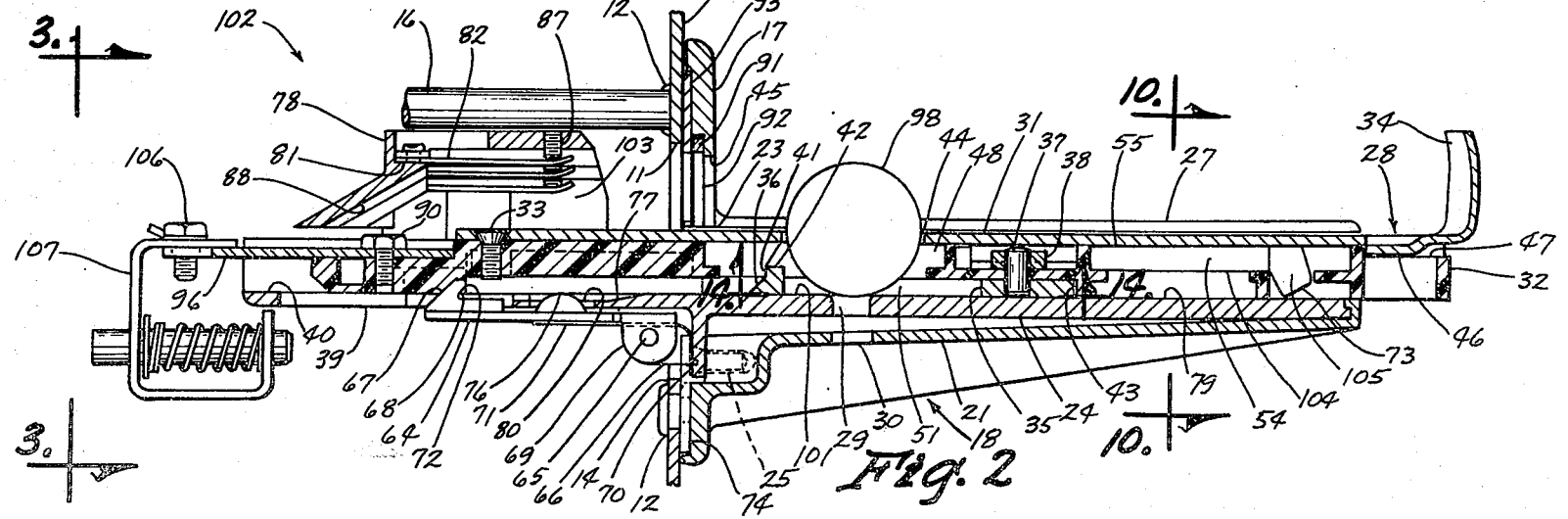
FIG. 2 is a sectional view taken along section lines 2—2 of FIG. 1, showing interior construction detail along a coin slot.

Referring to the drawings there is shown generally in FIG. 1 and further in the additional drawings a coin slide apparatus 10 so constructed as to be mounted in a standard coin slide vault panel opening 11, as shown in FIGS. 1 and 2, and thereby supported on a machine which is to be actuated by such a coin slide apparatus 10.

Referring to FIGS. 1 and 2, the coin slide apparatus 10 is mounted in a standard opening 11 cut into the front panel of the coin slide vault. This mounting is accomplished by sliding the apparatus 10 into the opening 11 and allowing the shouldered screws 12 to pass through clearance holes 13 at the top and clearance slots 14 at the bottom of the opening. The shoulder of the screws 12 allows the apparatus 10 to grip the vault wall 15 and final securing of the apparatus 10 is accomplished from within the vault by tightening a threaded rod 16 into faceplate 17 which draws the apparatus 10 snugly against the vault wall 15.

Figure 10:
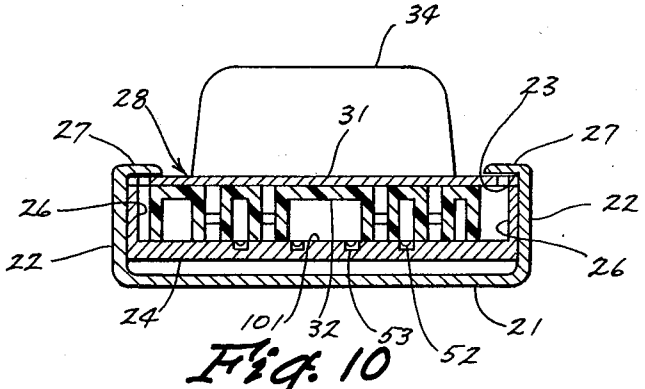
FIG. 10 is a section taken along lines 10—10 of FIG. 2.

Referring again to FIGS. 1, 2 and 3 the coin slide apparatus 10 includes a faceplate 17 and a forwardly extending housing support 18 which are cast as a unitary member. The forwardly extending housing support 18 includes a base 21 and a pair of opposed sidewalls 22 having inwardly extending flanges 27, as shown in FIG. 10, to define a rearwardly extending longitudinal channel 23 through the faceplate 17.

Figure 3:
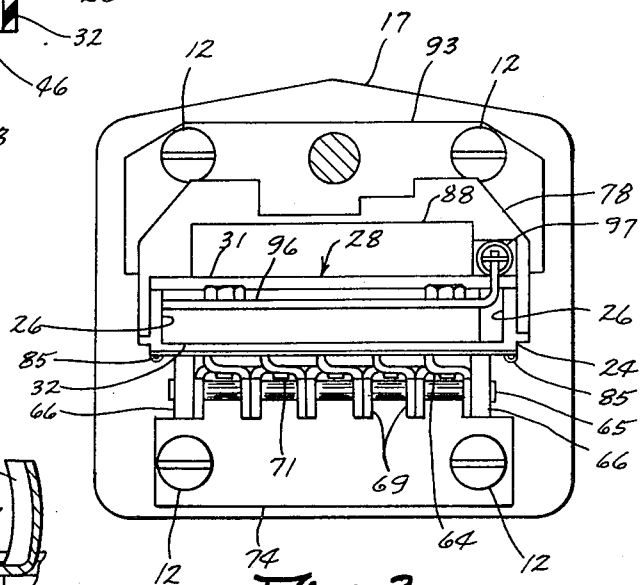
FIG. 3 is an end view taken along lines 3—3 of FIG. 2.

Assembled into the longitudinal opening 23 from the rear of the faceplate 17 is a slide housing 24, as shown in FIG. 2. The slide housing 24 is connected to the combination faceplate housing support by a pair of threaded fasteners 25. The slide housing 24 includes a short upwardly extending wall 26 at each side, as best shown in FIGS. 3 and 10, which cooperates with the flange 27 on the channels 22 of the housing support 18 to provide a guideway for a horizontally reciprocal slide assembly 28.

The slide housing 24 further includes an array of holes 29 in the guideway surface 101 and generally in line with a slotted opening 30 in the base 21 of the housing support 18. These holes 29 in combination with the slotted opening 30, provide limited access to the coins 98 from below and provide an outlet for dirt or soap granules.

Figure 14:
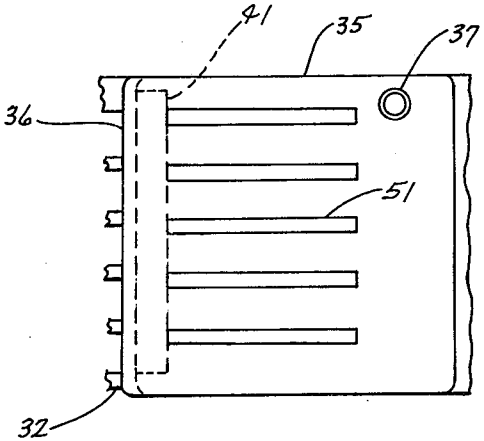
FIG. 14 is a view along lines 14—14 of FIG. 2 showing the bottom of the latch plate.

The reciprocally movable slide assembly 28 includes an upper slide plate 31 which is fixed to a center plate or center body portion 32 by a pair of screws 33. The upper slide plate 31 also includes an upturned handle 34, at the end opposite the screws 33, for operation of the slide assembly 28 within the guideway defined by the inwardly extending flanges 27 and upwardly extending walls 26 as shown in FIG. 10. The center body 32 is formed to receive a latch plate 35 as shown in FIGS. 2 and 14. The latch plate 35 is hardened and has a beveled leading edge 36 and a stud-like projection 37 which extends through the center body 32 to provide a pivot support for a ratchet pawl 38 which will be further defined. Immediately adjacent the beveled leading edge 36 of the latch plate 35 is a rib section 41 that extends transversely across the latch plate 35 as in FIGS. 2 and 14. This rib section 41 mates with a transverse groove 42 in the body portion 32 of the slide assembly 28 to locate the forward edge of the latch plate 35. The rear of the latch plate 35 is maintained in position by a downwardly extending wall 43 in the body portion 32. These features cooperating with the guideway serve to retain the latch plate 35 as part of the slide assembly 28.

The upper slide plate 31 includes coin slots 44 which are sized to receive coins 98 having particular denominations including two slots for quarters, two slots for dimes, and one slot for a nickel. The slots 44 in the upper slide plate 31 are aligned with vertical passageways 45, see FIGS. 2, 11 and 12, in the faceplate 17 which permit the passage of coins 98 that are positioned in the slide slots 44 and which partially extend above the surface of the upper slide plate 31. Though five slots 44 are shown in the upper slide plate 31, means are provided for blanking off up to four slots 44 as will be shown and discussed hereinbelow.

The coin slots 44 are shaped, as shown in FIG. 1, to approximate a particular coin's maximum permissible thickness and diameter at each end but are substantially wider at the center to accommodate a coin 98 which may be of the proper denomination but slightly deformed in the center. These slots 44 perform a preliminary measuring of a coin's width and thickness. The upper slide plate 31 also includes a rectangular detent 46 as shown in FIGS. 1 and 2. This detent rests in a notch 47 at the front of the center body 32 with the deepest portion of the detent 46 contacting the wall of notch 47. When the slide assembly 28 is operated, the detent 46 and notch 47 combination serves to transmit the operational impact force from the handle 34 and upper slide plate 31 to the center body 32 which prevents the application of undue force on the screws 33 that connect the upper plate 31 and center body 32.

As shown in FIG. 2, the center body 32 provides substantial thickness to the slide assembly 28 as compared to the thickness of the upper slide plate 31, and thus a significant portion of the coin 98 diameter is below the surface of the upper slide plate 31 when the coin 98 is of proper diameter. The center body portion 32 is molded from a thermoplastic material and includes a first transverse row of coin receiving pockets 48 below and substantially aligned with the slots 44 in the upper plate 31 but these coin receiving pockets 48 are of uniform size rather than of a size that corresponds to the size of the juxtaposed slot 44 in the upper slide plate 31. The latch plate 35 includes elongated openings 51 aligned with the slots 44 in the upper plate 31 and the first pockets 48 in the center body portion 32, as shown in FIGS. 2 and 14, to allow the lower edge of inserted coins to rest on the edges of the hole 29 on the surface of the guideway 101 of the slide housing 24.

As shown in FIG. 10, the center body portion 32 also includes a plurality of relatively small depending ribs 52 which mate with a plurality of shallow grooves 53 cast into the surface of the guideway 101 of the slide housing 24. These mating ribs 52 and grooves 53 cooperate to prevent the insertion of a thin flat sheet of rigid material between the slide assembly 28 and the slide housing 24 that is intended to effect improper actuation of the coin slide apparatus 10. The center body 32 further includes a second row of pockets or recesses 54, as shown in FIGS. 1 and 2, to receive in storage a plurality of blanking members 55.

Figure 9:
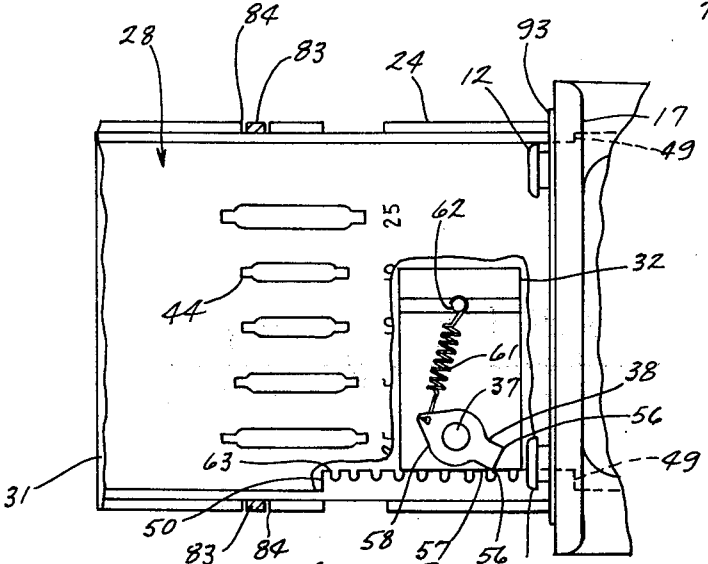
FIG. 9 is a fragmentary section showing the slide partially advanced.

The center body 32 supports a ratchet mechanism, as shown in FIGS. 1 and 9, where the pawl 38 is pivotally mounted on the projecting stud 37 of the latch plate 35. The ratchet pawl 38 is a hardened metal part having a center pivot with a generally rectangular shape at one end defining two sharp edges 56 for engagement with ratchet teeth 57 on either the forward or return stroke of the slide assembly 28 and a tapered opposite end 58 for attaching a pawl biasing member 61. The pawl biasing member 61 is connected between a molded peg 62 on the center body 32 and the trailing tapered portion 58 of the ratchet pawl 38. The toothed portion 57 of the ratchet mechanism is cast into a sidewall 63 of the slide housing 24 as shown in FIG. 9 and is operable for engagement with the ratchet pawl 38. Once the coin 98 passes through the coin measuring area 103, the ratchet pawl 38 engages with a ratchet tooth 57 as shown in FIG. 9 thus requiring the slide assembly 28 to be advanced past the remaining ratchet teeth 57. Once the slide assembly 28 and ratchet pawl 38 have been advanced past the ratchet teeth 57 to the operative position, as shown in dashed lines in FIG. 15, the ratchet pawl 38 will reverse and the ratchet teeth 57 will engage in a reverse direction during withdrawal of the slide assembly 28 so that the slide assembly 28 cannot be returned to the operative position before returning to the coin receiving position. The ratchet mechanism thus functions to require a complete slide assembly 28 reciprocation once an actuation has been effected so that coins cannot be returned rather than being ejected into a coin receptacle within the vault 102.

Pivotally mounted to the assembly of the housing support 18 and slide housing 24 are a plurality of latch arms 64, with one generally aligned with each of the slots 44 in the slide housing 24, as shown in FIGS. 2 and 3. These latch arms 64 are individually pivoted by a pair of downwardly turned ears 69 on a pin 65 which is in turn supported by two depending tabs 66 on the slide housing 24, FIG. 3. Each latch arm 64 includes at its free end a pawl 67 offset from the coin cam 76 center line and having a reverse inclined face 68 engageable with the hardened leading edge 36 of the latch plate 35 when the pawl 67 is in a first posture as shown in FIGS. 2 and 3 under the biasing of a leaf spring 71. Forwardly adjacent the inclined face 68, the edge 72 of the pawl 67 is beveled for engaging with the ramp portion 73 of a blanking member 55 to be described hereinbelow. A one-piece spring assembly 70 having a plurality of leaf springs 71 is formed from a flat sheet of spring stock. The individual leaf springs 71 are bent at right angles to the remaining rectangular sheet so that they extend rewardly under each latch arm 64 to upwardly bias each arm 64. The remaining rectangular base portion of the spring assembly 70 is retained by the slide housing 24 through a flat rectangular plate 74 and a pair of shouldered mounting screws 12, as shown in FIGS. 2 and 3. Each latch arm 64 also includes, at a position intermediate the pivot end and the free end, an upwardly extending, semicircular, cam surface 76 engageable with an inserted coin 98.

Also included in the surface of the guideway 101 of the slide housing 24 is a downward sloping ramp 77 which causes the coin or coins to drop by gravity from a first higher elevation 79 to a second lower elevation 80 prior to measuring. This change in elevation from higher to lower is necessary so that if an object other than a coin 98 is wedged into the coin slot 44 the object will not cam the latch arm 64 down since the object will be wedged at the higher elevation and will therefore be too high to engage the cam 76. The requirement that the coin 98 drop by gravity from a higher to a lower elevation requires that the coin 98 be free, whereas, if the coin 98 were being elevated from a lower level to a higher level a spurious coin could be wedged into the slot and be forced into the coin measuring area 103.

The most significant coin measuring is effected by a measuring system including the cam surface 76 of the latch arm 64. Behind the faceplate 17 is a bridge 78, as shown in FIGS. 1, 2, 3, and 13, having at irregular heights, supports 81 for flat fingerlike abutments 82 which are engageable with a coin diameter. The bridge 78 is located on the slide housing 24 as in FIG. 1 by means of tabs 83 on the lower edges of the bridge 78 and mating slots 84 on the edge of the slide housing 24 as best shown in FIG. 9. The bridge 78 is secured to the slide housing 24 with two snap flat springs 85, as in FIG. 1, which hook under the slide housing 24, as in FIG. 3, and snap into a recess 86 on each side of the bridge 78. The bridge 78 is thus restrained from movement and disassembly is simple.

Each abutment 82 is disposed above the coin cam 76 of a latch arm 64 with one end secured to the bridge 78 by staking and the opposite end positioned by a setscrew 87. The position of one end of the abutment 82 is adjustable with the setscrew 87, as in FIG. 2, so that the predetermined spacing between the abutment 82 and the coin cam 76 is such as to pivot the latch pawl 67 downward into a second posture for nonengagement with the latch plate 35 in the presence of a proper coin diameter. That ramp portion 88 of the bridge 78 immediately rearward of the coin measuring area 103 is sloped downward and rearward, as shown in FIG. 2, to impart a downward and rearward thrust to the coin 98 as it is ejected from the coin slide 28 through a port 39 in the slide housing 24. The combination of the ramp 88 and a stripper bar 40 at the end of the port 39 in the slide housing 24 serves to strip any coin 98 from the slide assembly 28 which may have been taped or otherwise held to the slide in an attempt to retrieve the coin 98 after actuation.

As previously indicated, up to four of the five coin slots 44 may be blocked off so that the indicated coin 98 is not required and in fact cannot be inserted into the coin slot 44 of the upper slide plate 31. Stored within the second center body recesses 54, as shown in FIGS. 1 and 2, are coin-blanking members 55 which are fabricated from a nonmagnetic material and include an elongated body portion 104 and a head portion 105 having a ramp 73 on the underside for engaging with the beveled edge 72 of the latch arm pawl 67 and camming the arm 64 downward into the previously mentioned second posture for nonengagement with the latch plate.

Figure 4:
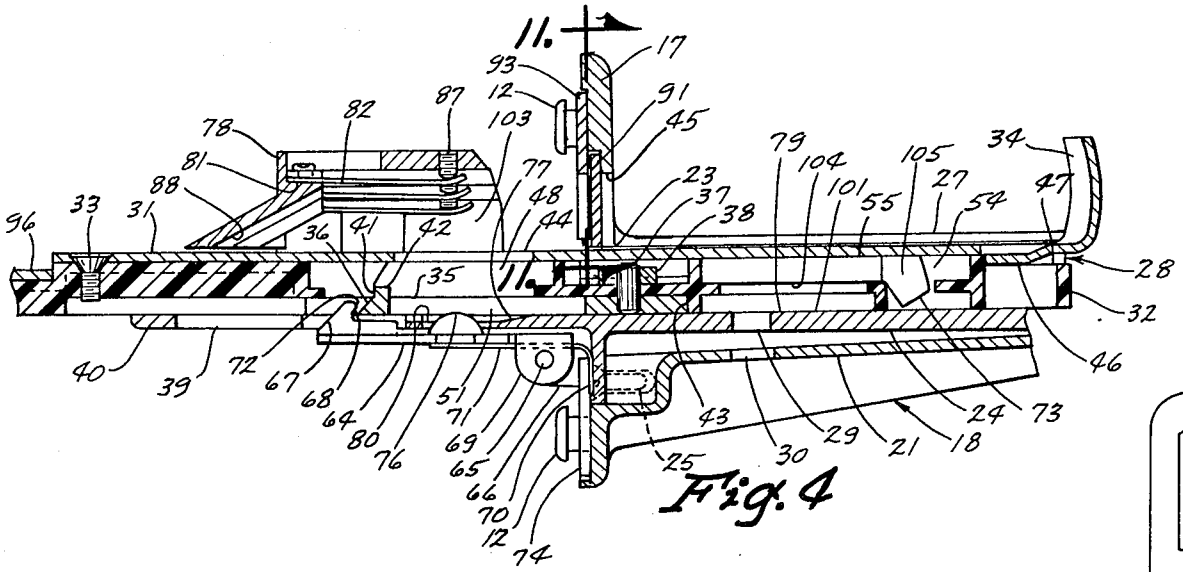
FIG. 4 is a view similar to FIG. 2 but showing the slide assembly advanced to an intermediate position without any coins.
Figure 7:
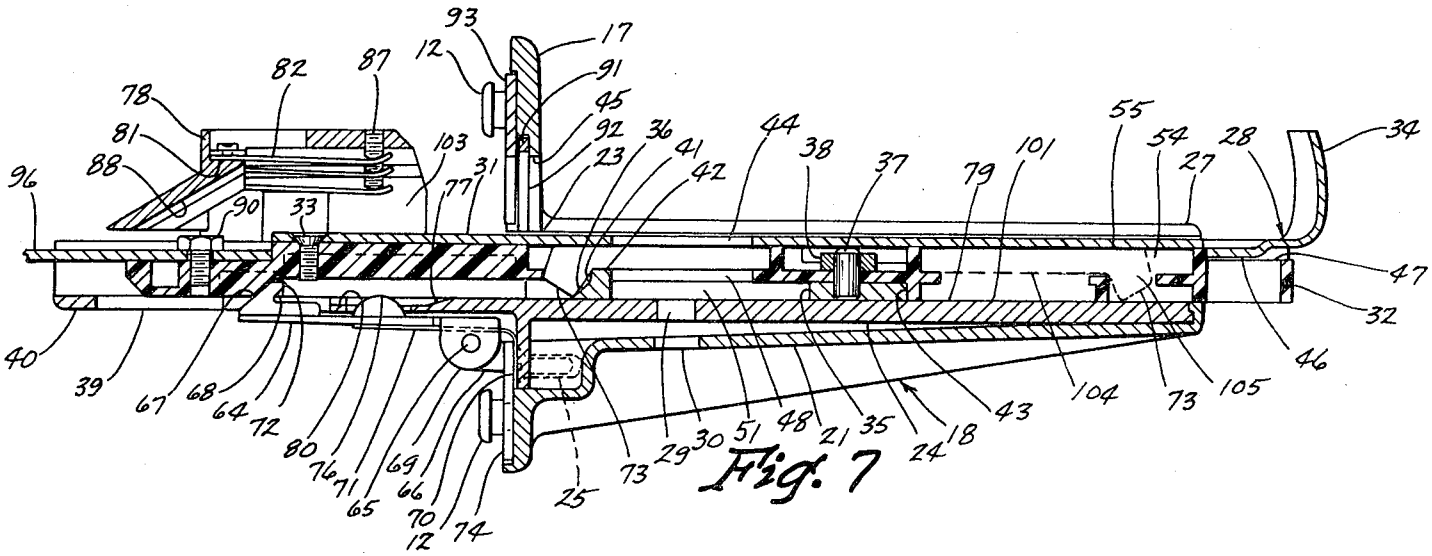
FIG. 7 is a view similar to FIG. 2 showing a blanking member in operative position.

To remove the upper slide plate 31 for conversion of the coin slide apparatus 10 from one combination of coins 98 to another, the slide assembly 28 is moved partially inward to expose the two mounting screws 33 as in FIG. 4. By removing these two screws 33 the upper slide plate 31 may be removed by sliding it forward through the faceplate 17 and away from the center plate 32 of the slide assembly 28 to expose the blanking members 55 disposed in the second row of pockets 54, as shown by broken line in FIG. 7, without disassembly of other parts. The blanking members 55 may then be removed from the second row of storage pockets or recesses 54 and placed in the first coin receiving pockets 48 so that the elongated body portion 104 will underlie the coin slot 44 in the upper slide plate 31 and the head portion 105 will extend downwardly to a position juxtaposed and to the left of the leading edge 36 of the latch plate 35 as in FIG. 7. The coin receiving slots 44 may be selectively blocked off so that the slide 28 may be adapted to receive and actuate at any 5 cent increment between a coin value of 5 cents to 75 cents. When the blanking member 55 are in a slot blanking position as shown by the unbroken line in FIG. 7, a coin 98 cannot be inserted into the coin slot 44 of the upper slide plate 31, and as the slide assembly 28 is advanced to the coin measuring area 103, the ramp 73 on the underside of the head 105 operates to engage the latch pawl 67 and to depress it to a position below the lower surface of the latch plate 35 to thus obviate the need for a coin 98 in the particular slot.

Figure 8:
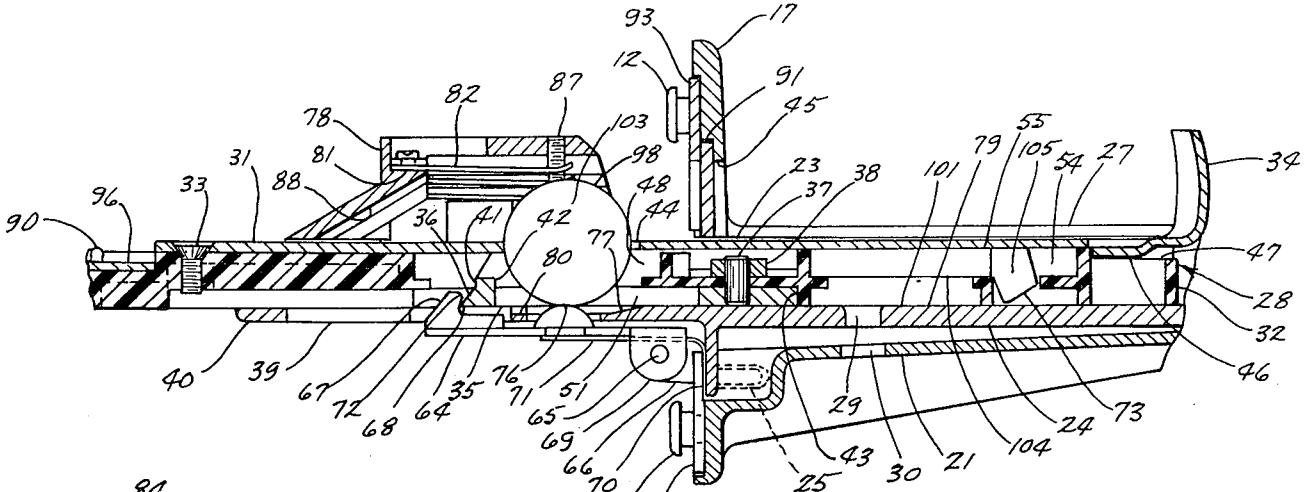
FIG. 8 is a view similar to FIG. 2 showing that a too small coin will not pass through the coin measuring area.
Figure 12:
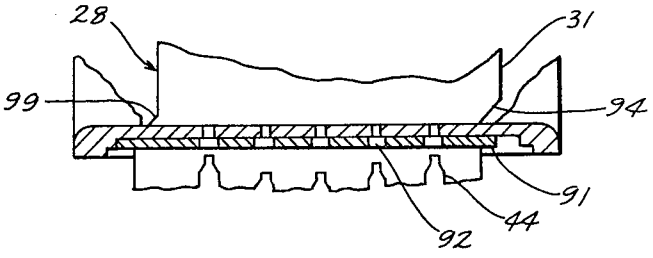
FIG. 12 is a section taken along lines 12—12 of FIG. 11 showing the action of the door as the slide is advanced or retracted.
Figure 11:
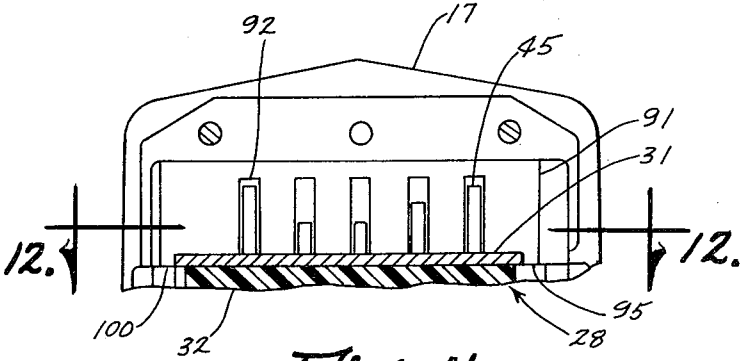
FIG. 11 is a section taken along lines 11—11 of FIG. 4 showing the slide actuated door in the housing support.
Figure 13:
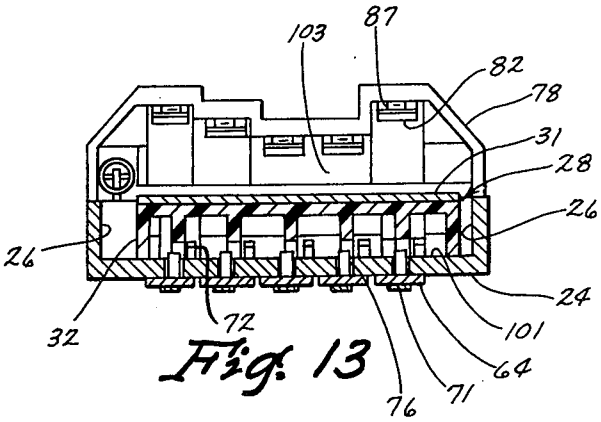
FIG. 13 is a section taken along lines 13—13 of FIG. 1 looking into the coin measuring area.

On the rear of the faceplate 17 is a flat sliding door 91, as shown in FIGS. 11 and 12, that includes a plurality of passageways 92 and is retained in position by a retainer plate 93 as shown in FIG. 8. In the coin receiving position of the slide assembly 28 as in FIG. 1, the passageways 92 in the door 91 are generally aligned with the passageways 45 in the faceplate 17 as in FIGS. 11 and 12 so that coins may pass through. As the coins 98 clear the passageway 92, however, the door 91 is moved transversely relative to the faceplate 17 by a cam surface 94 on the upper slide plate 31 engaging with a depending tab 95 on the sliding door 91 to effectively close the passageways 45 in the faceplate 17, thus preventing access to the coin measuring members during and after the measuring process. As the slide assembly 28 is returned to the coin receiving position, the sliding door 91 is returned by a cam 99 and depending tab 100 on the opposite side of the upper slide plate 31 and door 91 respectively to realign the passageways 45 and 92. The door passageways 92 are also formed with sharp edges to effect a cutting of tape or the like that may be attached to the coin 98 and thereby thwarting any attempt to obtain improper return of the coin 98 after effecting an actuation of the machine.

The slide assembly 28 is adapted to receive an actuator mounting bracket 96 secured by fasteners 90 as shown in FIGS. 1 and 2. Similarly, an actuator bracket 107, which is operable for actuating the timer 108 or other control device to initiate operation of the machine, is attached to the mounting bracket 96 by a pair of threaded members 106.

Figure 5:
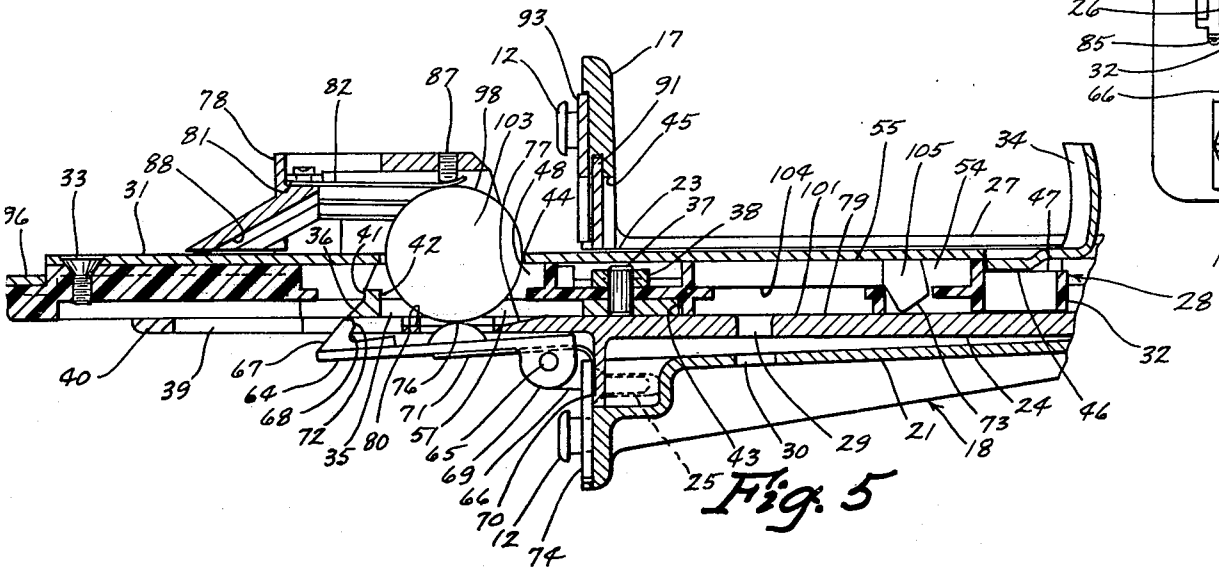
FIG. 5 is a view similar to FIG. 2 showing a proper coin advancing through the coin measuring area.
Figure 15:
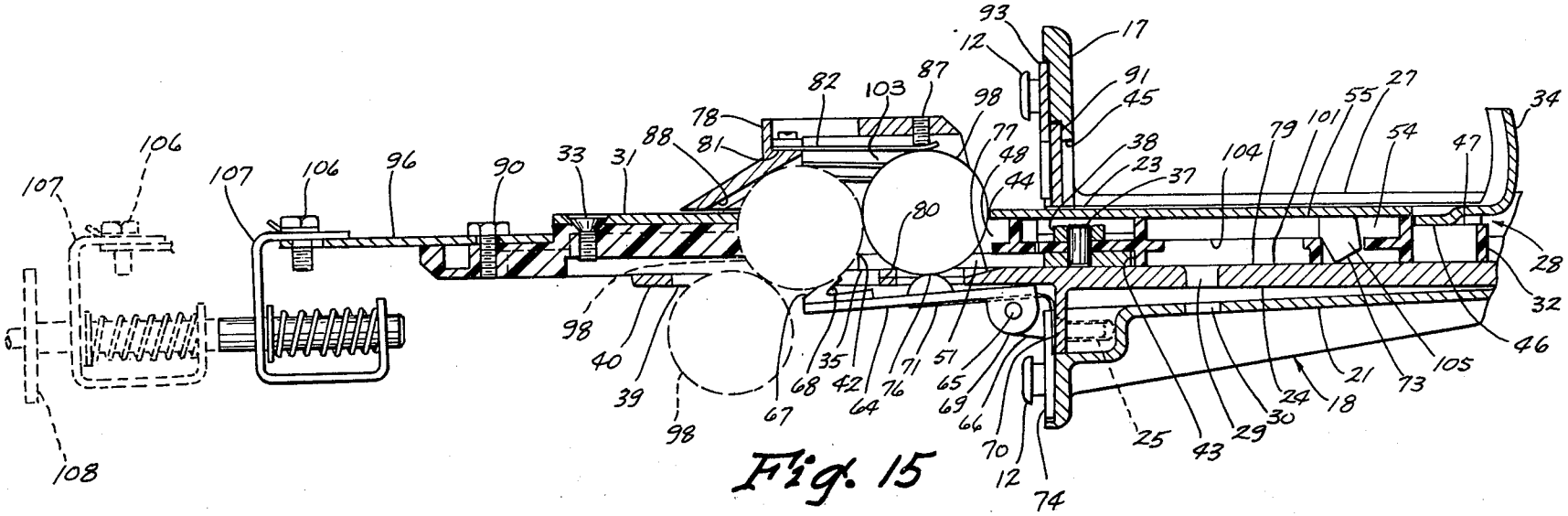
FIG. 15 is a view similar to FIG. 5 showing a proper coin advancing through the coin ejection position and leaving the coin slide; also shown in dashed lines is the end of a fully extended coin slide in the operative position.

For purposes of discussing operation of the coin slide apparatus 10 with a proper coing 98, as in FIG. 5, it is assumed that a blanking member 55 has been operatively disposed in all of the coin slot 44 positions except one of the quarter slots through which the section of FIG. 5 is taken. After an authentic quarter is inserted in the appropriate slot 44, and enters the slot 44 with the lower edge resting on the surface of the guideway 101 of the slide housing 24 if the coin 98 is proper, the slide assembly 28 is advanced to carry the coin 98 toward the faceplate 17 and through the vertical passageway 45 therein. After the coin 98 passes the vertical passageway 45, the door 91 is cammed by the upper slide plate 31 transversely across the back of the faceplate 17, as in FIGS. 11 and 12, to block any further access to the coin 98. Continued advancement of the slide assembly 28 moves the coin 98 to the coin measuring area 103. During this advancement the coin 98 is moved down the ramp 77 formed in the slide housing 24 to the semicircular coin cam 76. With the bottom edge of the coin 98 engaging the coin cam 76 and the upper edge engaging the abutment 82, the latch arm 64 is pivoted downwardly by the advancing coin to position the latch pawl 67 below the plane of the latch plate 35. The slide assembly 28 is thus free to continue advancement through the coin ejection position, where the ramp portion 88 of the bridge 78 starts the coin 98 downward and rearward through a port 39 in the slide housing 24, as shown in FIG. 15, to the operative position. At the end of the actuation stroke of the slide assembly 28, the slide assembly 28 mounted actuator bracket 107 engages and effects operation of a timer 108 or the like. When the slide assembly 28 has reached this operative position it is prevented from further travel by the engagement of the stops 19 on the center body 32 with a mating forward land 49 on each upwardly extending wall 26 of the slide housing 24 as shown in FIG. 9. Upon completion of the inward actuation stroke of the slide assembly 28, the assembly 28 is returned to the coin receiving position by a return spring 97 that is mounted between the side of the actuator mounting bracket 96 and the retainer plate 93 as shown in FIG. 1. The return stroke is limited by the engagement of the actuator mounting bracket 96 with a rearward land 50 shown in FIG. 9.

Figure 6:
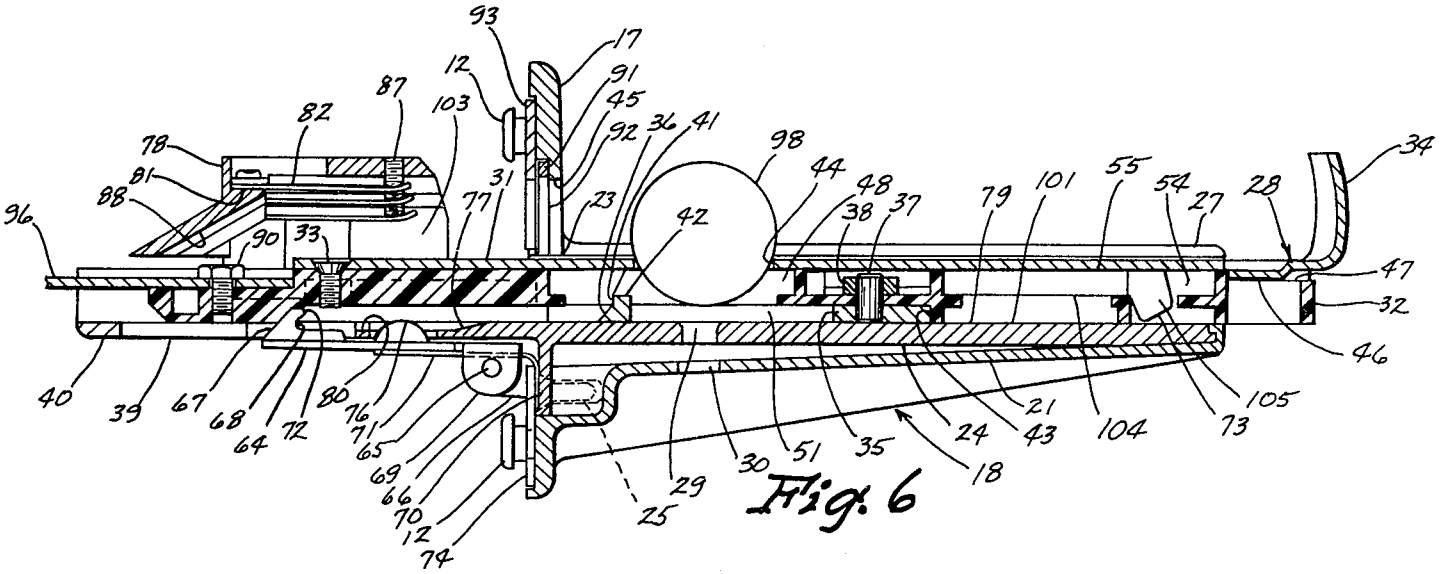
FIG. 6 is a view similar to FIG. 2 illustrating that a too large coin will not drop into the slot.

In the event that a coin 98 which is too large in diameter is used to attempt actuation of the machine, the coin will not seat properly in the coin slot 44 as shown in FIG. 6. With the too large coin 98 in this position, the slide assembly 28 will not be operable since the top of the coin 98 cannot clear the top edge of the vertical passageway 45 in the faceplace 17. In the event that a coin 98 is too thick, it will not pass the maximum thickness requirements of the coin slots 44 in the upper slide plate 31 and thus cannot be used.

Shown in FIG. 8 is the condition that occurs when a coin 98 of too small a diameter is used in an attempt to actuate the machine. The too small coin 98 will fit in the coin slot 44 and rest upon the slide housing 24. As the slide assembly 28 is advanced, the coin 98 will travel through the vertical passageway 45 in the faceplate 17, down the ramp 77 in the slide housing 28, and to the coin measuring area 103. At the coin measuring area 103, as shown in FIG. 8, the coin 98 is not large enough in diameter to span the distance between the coin cam 76 and the abutment 82, hence, the latch arm 64 is not cammed down and the latch plate 35 engages the pawl 67 of the latch arm 64, thus preventing any further advancement of the slide assembly 28.

Further, if actuation of the coin slide apparatus 10 is attempted without the presence of a coin 98 as shown in FIG. 4, the latch plate 35 will simply engage the pawl 67 of the latch arm 64 and prevent further advancement of the slide assembly 28.

The present construction thus provides an improved coin slide apparatus offering fast, convenient conversion from one combination of coins to another. The construction offers a unique slide assembly having improved operational characteristics and providing for storage of conversion pieces. The present slide assembly is also functional as a structural support for a ratchet mechanism and as a load bearing member capable of absorbing shock impacts as well as performing the usual authenticating and actuation functions of a prior art slide assembly.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A coin slide apparatus for initiating the operation of a machine with a predetermined combination of coins supported on edge and convertible from one actuating combination of coins to another, the combination comprising: slide support means for mounting said coin slide apparatus to said machine and including a generally vertical faceplate having at least one opening for passing coins on edge and further including a slide housing defining a coin slide guideway extending through said faceplate; a coin slide assembly supported on said slide housing and reciprocally movable in said guideway, said slide assembly including an upper slide plate having a plurality of coin slots of predetermined size for receiving said coins, a body portion fastened to said upper slide plate and having a plurality of coin receiving pockets aligned below said slots in said upper slide plate for receiving said coins standing generally vertically on edge, and a lower latch plate having openings generally aligned with said slots in said upper slide plate and with said pockets in said body portion, said latch plate being retained as a part of said slide assembly for movement therewith, said slide assembly being reciprocal from a coin receiving position and through intermediate coin measuring and coin ejecting positions to an operative position for activiating said machine; slide movement control means for preventing movement of said slide assembly to said operative position in the absence of said predetermined combination of authentic coins and including a plurality of latch arms engageable with said latch plate in the absence of coins of a predetermined diameter; and coin ejection means including at least one open port in said slide housing at said coin ejecting position through which coins are ejected.

2. A coin slide apparatus as defined in claim 1 wherein said coin ejection means further includes a stripper bar on said slide housing adjacent to said open port and responsive to movement of said slide assembly for removing coins which have been secured to said slide assembly.

3. A coin slide apparatus as defined in claim 1 wherein said guideway of said slide housing includes a plurality of grooves for receiving mating ribs formed in the underside of said body portion of said slide assembly to effectively prevent insertion of a thin flat sheet between said slide housing and said slide assembly thereby preventing improper actuation with said sheet.

4. A coin slide apparatus as defined in claim 1 and further including a plurality of coin slot blanking members storable in said slide assembly and selectively movable to a position juxtaposed to one of said pockets for blanking one of said coin slots and obviating the requirement for a coin in said one coin slot.

5. A coin slide apparatus as defined in claim 1 and further including means for preventing improper actuation of said coin slide apparatus by preventing the return of said slide assembly from a position beyond said coin measuring position without advancing said slide assembly through said coin ejecting position to said operative position including a ratchet pawl mounted on said slide assembly and ratchet teeth formed in said slide housing, said center body portion including a recess for receiving said ratchet pawl whereby said ratchet pawl is movable with said slide assembly for engagement with ratchet teeth in said slide housing.

6. A coin slide apparatus for initiating the operation of a machine with a predetermined combination of coins supported on edge and convertible from one actuating combination of coins to another, the combination comprising: slide support means for mounting said coin slide apparatus to said machine and including a generally vertical faceplate having a plurality of vertical passageways for passing coins on edge and further including a slide housing defining a coin slide guideway extending through said faceplate; a coin slide assembly supported on said slide housing and reciprocally movable in said guideway, said slide assembly including an upper slide plate having a plurality of coin slots of predetermined size for receiving said coins, a body portion fastened to said upper slide plate and having a plurality of coin receiving pockets aligned below said slots in said upper slide plate for receiving said coins generally vertically on edge, and a lower latch plate having openings generally aligned with said slots in said upper slide plate and with said pockets in said body portion, said latch plate being retained transversely and vertically as a part of said slide assembly by said guideway and by said body portion in said slide housing, said slide assembly being reciprocal from a coin receiving position and through intermediate coin measuring and coin ejecting positions to an operative position for activating said machine; a plurality of latch arms pivotally mounted on said slide housing with one latch arm substantially in line with each of said coin slots in said coin slide assembly, said latch arms having free end pawls for engaging said latch plate to prevent movement of said slide assembly beyond said coin measuring position; coin authenticating means including a cam on each of said latch arms and an abutment above the cam of each latch arm, said cam and abutment defining therebetween a predetermined space for measuring coins and permitting said coin slide when containing the proper combination of coins of predetermined diameter to pass through said coin measuring position by camming said latch arms downward to clear said latch plate; and coin ejection means including at least one open port in said slide housing at said coin ejecting position through which coins are ejected.

7. A coin slide apparatus as defined in claim 6 and further including a plurality of coin slot blanking members storable in said slide assembly and selectively movable to a position juxtaposed to one of said pockets for blanking one of said coin slots and wherein said blanking member further includes an operative portion engageable with the latch arm in line with said one coin slot for camming said latch arm downward to obviate the requirement for a coin in said one coin slot.

8. A coin slide apparatus as defined in claim 6 wherein said body portion is molded of thermoplastic material and said upper slide plate includes a handle for operation of said coin slide assembly from said coin receiving position to said operative position and wherein said upper slide plate further includes a detent generally rearwardly adjacent said handle for mating with a notched-out portion in the front of the molded thermoplastic body portion of said slide assembly for effectively transmitting operational impact force from said handle to said body portion.

9. A coin slide apparatus for initiating the operation of a machine with a predetermined combination of coins supported on edge and convertible from one actuating combination of coins to another, the combination comprising: a forwardly extending housing support for mounting said coin slide apparatus to said machine including a generally vertical faceplate having a plurality of vertical passageways for passing coins on edge; a slide housing retained by and cooperating with said housing support to define a forwardly and rearwardly extending coin slide guideway; a coin slide assembly supported on said slide housing and reciprocally movable in said guideway, said slide assembly including an upper slide plate including a plurality of coin slots of predetermined size for receiving and effecting preliminary measuring of each of said coins, a center body portion fastened to said upper slide plate and having a plurality of coin receiving pockets aligned below said slots in said upper slide plate for receiving said coins standing generally vertically on edge, and a lower latch plate having openings generally aligned with said slots in said upper slide plate and with said pockets in said center body portion, said latch plate being retained transversely and vertically as a part of said slide assembly by said guideway in said slide housing, said slide assembly being reciprocal from a coin receiving position and through intermediate coin measuring and coin ejecting positions to an operative position for activating said machine; a plurality of latch arms pivotally mounted on said slide housing with one latch arm substantially in line with each of said coin slots in said coin slide assembly, said latch arms having free end pawls biased into engagement with said latch plate to prevent movement of said slide assembly beyond said coin measuring position; coin authenticating means including a cam on each of said latch arms and an abutment above the cam of each latch arm, said cam and abutment defining therebetween a predetermined space for measuring coins and permitting said coin slide when containing the proper combination of coins of predetermined diameter to pass through said coin measuring position by camming said latch arms downward to clear said latch plate; and coin ejection means including at least one open port in said slide housing at said coin ejecting position through which coins are ejected.

10. A coin slide apparatus for initiating the operation of a machine with a predetermined combination of coins supported on edge and convertible from one actuating combination of coins to another, comprising: slide support means for mounting said coin slide apparatus to said machine and including a generally vertical faceplate having a plurality of vertical passageways for passing coins on edge and further including a slide housing defining a coin slide guideway extending through said faceplate; a coin slide assembly supported on said slide housing and reciprocally movable in said guideway from a coin receiving position and through intermediate coin measuring and coin ejecting positions to an operative position for activating said machine, said coin slide assembly including an upper slide plate, a center body portion and a latch plate, said upper slide plate having a plurality of coin slots of predetermined size for receiving and effecting preliminary measurement of each of said coins, said center body portion including a first plurality of elongated coin receiving pockets directly below said coin slots in said upper plate for receiving said coins on edge during said reciprocation and further having a second plurality of elongated pockets spaced from said first plurality of pockets and covered by said upper plate, said latch plate having openings generally aligned with said slots in said top slide plate and with said first pockets in said center body portion, said upper plate being disengageably joined to said center body portion with removable fastening means; a plurality of latch arms pivotally mounted on said slide housing with one latch arm substantially in line with each of said coin slots in said coin slide assembly, said latch arms having free end pawls biased for engagement with said latch plate to prevent movement of said slide assembly beyond said coin measuring position; slot blanking members storable in said second plurality of pockets in said center body portion and individually manually movable to selected pockets of said first plurality of pockets for conversion of said slide assembly from one actuating combination of coins to another, said blanking members having elongated body portions for blanking said coin slots in said upper slide plate to prevent coin insertion and further having head portions including a ramp for engaging said pawl on said latch arm and operable for camming said latch arm down to obviate the need for a coin in a selected slot; coin authenticating means including a cam on each of said latch arms and an abutment above the cam of each latch arm, said cam and abutment defining therebetween a predetermined space for measuring coins and permitting said coin slide when containing the proper combination of coins of predetermined diameter to pass through said coin measuring position by camming said latch arms downward to clear said latch plate; and coin ejection means including at least one open port in said slide housing at said coin ejecting position through which coins are ejected.

11. A coin slide apparatus as defined in claim 10 wherein said blanking members are accessible for said conversion by disengaging said fastening means and removing said upper slide plate thereby exposing said blanking members for manual manipulation.

12. A coin slide apparatus as defined in claim 10 wherein said plurality of coin slots includes two quarter slots, two dime slots and a nickel slot and wherein said slot blanking members are maneuverable from said second pockets to any of the said first pockets below said coin slots whereby said coin slide apparatus can be adapted to receive and actuate with coin combinations ranging from 5 cent to 75 cents in 5 cent increments.

* * * * *